US010744631B2

(12) United States Patent
Dittrich

(10) Patent No.: US 10,744,631 B2
(45) Date of Patent: Aug. 18, 2020

(54) SETTING TOOL AND METHOD FOR OPERATING A SETTING TOOL

(71) Applicant: HILTI AKTIENGESELLSCHAFT, Schaan (LI)

(72) Inventor: Tilo Dittrich, Feldkirch (AT)

(73) Assignee: HILTI AKTIENGESELLSCHAFT, Schaan (LI)

( * ) Notice: Subject to any disclaimer, the term of this patent is extended or adjusted under 35 U.S.C. 154(b) by 495 days.

(21) Appl. No.: 15/534,717

(22) PCT Filed: Dec. 9, 2015

(86) PCT No.: PCT/EP2015/079055

§ 371 (c)(1),
(2) Date: Jun. 9, 2017

(87) PCT Pub. No.: WO2016/091920

PCT Pub. Date: Jun. 16, 2016

(65) Prior Publication Data

US 2017/0334050 A1 Nov. 23, 2017

(30) Foreign Application Priority Data

Dec. 12, 2014 (EP) ..... 14197559

(51) Int. Cl.

| | |
|---|---|
| ***B25C 1/06*** | (2006.01) |
| ***B25C 1/08*** | (2006.01) |
| *B25C 5/15* | (2006.01) |

(52) U.S. Cl.

CPC ..... *B25C 1/06* (2013.01); *B25C 1/08* (2013.01); *B25C 5/15* (2013.01)

(58) Field of Classification Search

CPC .. B25C 1/04; B25C 1/008; B25C 1/08; B25C 1/06; B25C 5/15; B25D 9/10

(Continued)

(56) References Cited

U.S. PATENT DOCUMENTS 4,042,036 A * 8/1977 Smith ..... B25C 1/005 173/13
4,928,868 A * 5/1990 Kerrigan ..... B25C 1/06 173/13

(Continued)

FOREIGN PATENT DOCUMENTS

| | | |
|---|---|---|
| DE | 103 25 920 B4 | 9/2005 |
| DE | 10 2005 000062 A1 | 11/2006 |
| WO | WO 2009/140728 A1 | 11/2009 |

OTHER PUBLICATIONS

European Patent Office, European Search Report in corresponding European Application No. 14 19 7559, dated Jun. 10, 2015.

(Continued)

*Primary Examiner* — Scott A Smith
(74) *Attorney, Agent, or Firm* — Leydig Voit & Mayer, Ltd.

(57) ABSTRACT

The invention relates to a setting tool for fastening elements, comprising a driving piston that can be driven by a primary drive, and comprising a secondary drive. In order to create a lightweight, handy setting tool, the primary drive is combined with the secondary drive in a hybrid drive system for the driving piston in such a way that the driving piston can be driven by both the primary drive and the secondary drive.

10 Claims, 1 Drawing Sheet

(58) Field of Classification Search
USPC ..... 227/8, 9, 10, 130, 131, 129; 123/46 SC; 173/1, 117, 202, 122
See application file for complete search history.

(56) References Cited

U.S. PATENT DOCUMENTS 4,946,087 A * 8/1990 Wingert ..... B25C 5/15 227/131
5,098,004 A * 3/1992 Kerrigan ..... B25C 5/15 173/121
5,213,247 A * 5/1993 Gschwend ..... B25C 1/08 227/10
5,398,537 A * 3/1995 Michalewski ..... B21J 15/24 29/243.54
6,502,008 B2 * 12/2002 Maurer ..... B21J 15/025 29/716
6,526,852 B2 * 3/2003 Rahmsdorf ..... B25B 21/023 173/117
6,796,477 B2 * 9/2004 Chen ..... B25C 1/06 227/131
7,165,305 B2 * 1/2007 Kenney ..... B25C 1/06 173/1
8,091,751 B2 * 1/2012 Tanaka ..... B25C 1/08 227/10
2004/0084503 A1 * 5/2004 Chen ..... B25C 1/06 227/131
2005/0109813 A1 5/2005 Ehmig et al.
2006/0261127 A1 * 11/2006 Wolf ..... B25C 1/06 227/131
2008/0087705 A1 4/2008 Wolf et al.
2008/0314952 A1 * 12/2008 Tamura ..... B25C 1/08 227/10
2011/0068142 A1 * 3/2011 Webb ..... B25C 1/08 227/10

OTHER PUBLICATIONS

International Bureau, International Search Report in International Application No. PCT/EP2015/079055, dated Mar. 9, 2016.

* cited by examiner

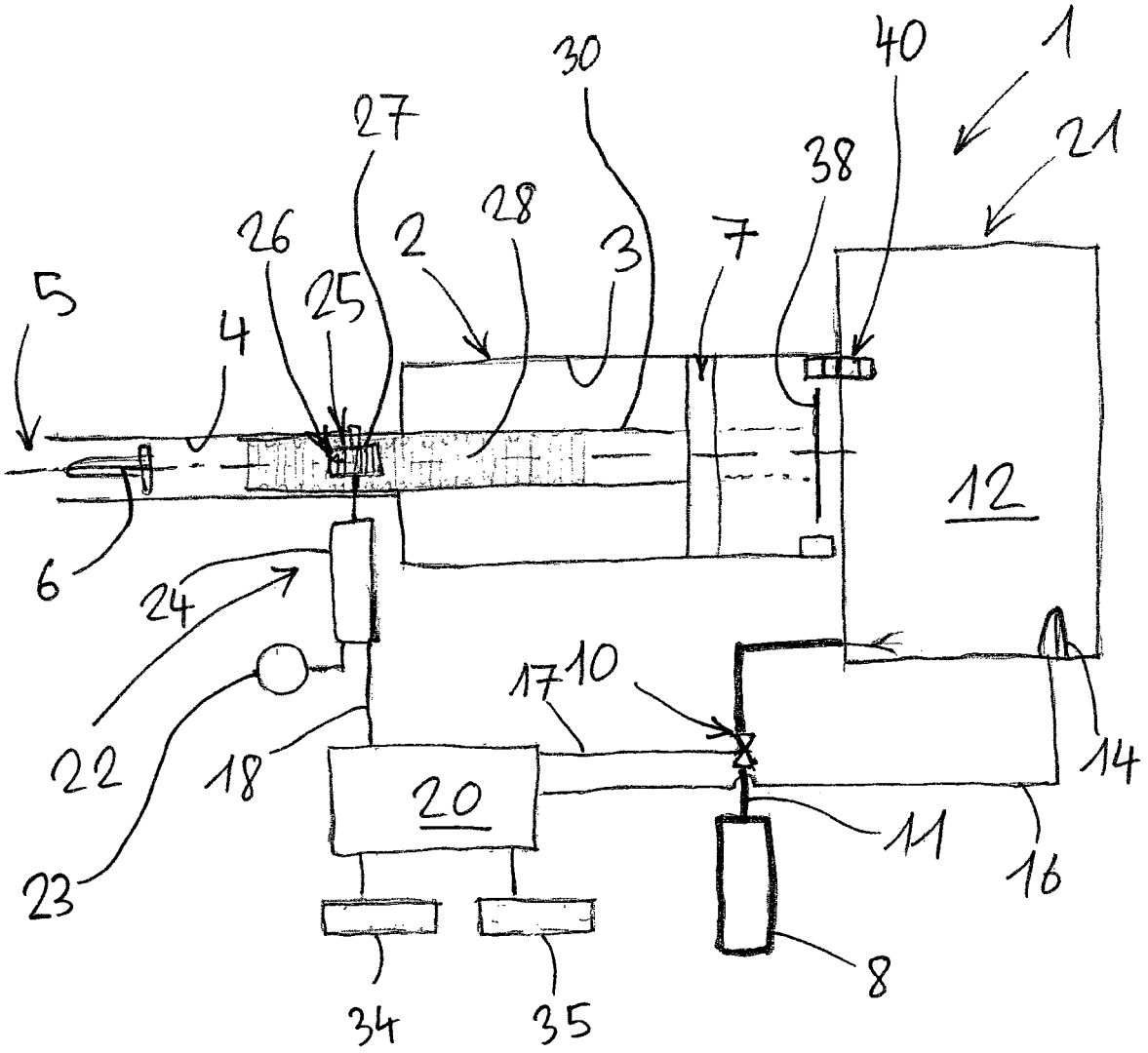
1
21
40
30
27
38
28
26
2
3
7
5
25
4
12
6
24
22
17
10
14
18
20
11
16
23
8
34
35

SETTING TOOL AND METHOD FOR OPERATING A SETTING TOOL

CROSS-REFERENCE TO RELATED APPLICATIONS

This patent application is the U.S. National Stage of International Application No. PCT/EP2015/079055, filed Dec. 9, 2015, which claims the benefit of European Application No. 14197559.9, filed Dec. 12, 2014, which are each incorporated by reference.

TECHNICAL FIELD

The invention relates to a setting tool for fastening elements, comprising a driving piston which can be driven by a primary drive, and comprising a secondary drive. Furthermore, the invention relates to a method for operating such a setting tool.

BACKGROUND OF THE INVENTION

German patent DE 103 25 920 B4 discloses a setting tool for fastening elements, which tool can be driven by means of expandable gases, comprising a piston guide in which a driving piston can be movably supported and a piston return device by means of which the driving piston can be moved into a starting position again after a setting operation, wherein the piston return device has a drive means powered by an electric motor and at least one transmission device for transmitting the motor-powered positioning force to the driving piston.

BRIEF SUMMARY OF THE INVENTION

The object of the invention is to create a lightweight and handy setting tool which enables the provision of a high setting energy.

In a setting tool for fastening elements, comprising a driving piston which can be driven by a primary drive, and comprising a secondary drive, this object is achieved in that the primary drive is combined with the secondary drive in a hybrid drive system for the driving piston in such a way that the driving piston can be driven by both the primary drive and also the secondary drive. The secondary drive is used not only, as in the setting tool known from German patent DE 103 25 920 B4, to return the driving piston. According to a significant feature of the invention, the secondary drive is combined with the primary drive in the hybrid drive system so that the secondary drive can also be used additionally, at least secondarily, or solely for accelerating the driving piston A preferred exemplary embodiment of the setting device is characterized in that the primary drive is a gas-powered drive. In connection with the setting tool, the term "gas-powered drive" means that the driving piston is driven by means of an expandable gas. A defined amount of the expandable gas is preferably ignited in a combustion chamber by a suitable ignition device, such as an igniter plug. The expandable gas then expands suddenly, so that the driving piston is accelerated.

A further preferred exemplary embodiment of the setting device is characterized in that the secondary drive is an electric motor-powered drive. The electric motor-powered drive is used not only for application of a positioning force to the driving piston, but particularly advantageously for application of a driving force to the driving piston in order to accelerate it. However, the electric motor-powered drive can also be used in order to move the driving piston in the direction of a combustion zone in order to compress, in particular to pre-compress or to supercharge, the expandable gas in the combustion zone.

A further preferred exemplary embodiment of the setting device is characterized in that the secondary drive is drivingly connected to a piston rod of the driving piston. The driving connection between the secondary drive and the piston rod of the driving piston may be produced for example by interengaging toothings or by a friction gear.

A further preferred exemplary embodiment of the setting device is characterized in that the primary and the secondary drive are connected in control terms to a common control unit. The primary drive which is configured, for example, as a gas-powered drive, and in particular a combustion process in the combustion zone of the primary drive, are controlled by means of the common control unit. For control of the combustion, in particular the gas proportioning and ignition of the expanded gas in the combustion zone are controlled. For control of the electric motor-powered drive, which preferably constitutes the secondary drive, at least one electric motor is, for example, connected in control terms to the common control unit. The control of the two drives by means of the common control unit preferably takes place as a function of the current drive-in energy requirement.

A further preferred exemplary embodiment of the setting device is characterized in that a clutch which allows uncoupling of the secondary drive from the driving piston is associated with the secondary drive. This provides the advantage that the secondary drive, in particular the electric motor-powered drive, can be engaged or disengaged as required.

The invention also relates to a method for operating a previously described setting tool. Due to the combination according to the invention of the two drives in the hybrid drive system for the driving piston, modes of operation of the setting tool are made possible which are not feasible with conventional setting tools. This has a particularly advantageous effect on the operation of the setting tool which is optimized with regard to the energy requirement and in particular is controlled as a function of the current drive-in energy requirement.

A preferred exemplary embodiment of the method is characterized in that the setting tool has at least a first mode of operation, in which the driving piston is accelerated solely by the primary drive, and at least a second mode of operation, in which the driving piston is accelerated by the primary and the secondary drive. The first mode of operation corresponds to a standard combustion engine. After a setting operation, the driving piston can be returned again to a starting position by a thermal piston return which is conventional in gas devices and/or by the secondary drive. The second mode of operation is also designated as a hybrid drive. In the second mode of operation the driving piston is preferably accelerated by the combustion pressure provided by the primary drive and by the electrical drive which constitutes the secondary drive.

A further preferred exemplary embodiment of the method is characterized in that the setting tool has at least a third mode of operation, in which the driving piston is accelerated solely by the secondary drive. This mode of operation is also designated as an electric drive. The third mode of operation is suitable particularly advantageously for fields of application in which a relatively low setting energy is required.

A further preferred exemplary embodiment of the method is characterized in that the secondary drive is used in order to supercharge the combustion zone of the primary drive with the aid of the driving piston. This mode of operation is also designated as a combustion engine with supercharging. In this case the secondary drive is used in order to compress, in particular to pre-compress, expandable gas in the combustion zone of the primary drive. A subsequent piston acceleration of the driving piston then takes place due to the combustion pressure increased as a consequence of the supercharging. In this way more setting energy can be released than with conventional setting tools.

A further preferred exemplary embodiment of the method is characterized in that the primary drive, in particular the gas proportioning and/or ignition of the primary drive, is controlled by means of a common control by means of which the secondary drive is also controlled. The common control makes it possible in a simple manner to optimize the operation of the setting tool in energy terms as a function of the drive-in energy requirement.

Furthermore, the invention relates to a computer program product with a program code for carrying out the previously described method, in particular if the program is executed in the controller of the setting device.

Further advantages, features and details of the invention are apparent from the following description in which various embodiments of the invention are described in detail with reference to the drawings.

BRIEF DESCRIPTION OF THE VIEW OF THE DRAWING

The sole accompanying drawing shows a simplified representation of a setting device according to the invention.

DETAILED DESCRIPTION OF THE INVENTION

In the accompanying drawing a setting tool 1 with a housing 2 is shown in highly simplified form. The housing 2 comprises a handle (not shown), on which the setting tool 1 can be mounted for driving in a fastening element 6 which extends out of the setting tool 1 at a setting end 5 and can be driven into a substrate (likewise not shown).

The fastening elements 6 which are used are preferably provided by means of a magazine (not shown) which is located inside the device and is mounted in the vicinity of the setting end 5 on the setting tool 1. The fastening elements 6 are automatically withdrawn, preferably individually, from the magazine and are provided in an element guide 4 at the setting end 5.

Energy required for driving the fastening elements 6 into the substrate is transmitted to the fastening element 6 in the piston guide 3 by means of a driving piston 7 which is guided in the piston guide 3.

Energy required for driving the fastening elements 6 into the substrate is provided, for example, in a fuel tank 8 in the interior of the setting tool 1. The fuel in the fuel tank 8 is preferably an expandable gas, such as liquid gas. Therefore the fuel tank 8 is also designated as a gas canister or gas cartridge.

The fuel tank 8 can be connected by means of an adjustable or regulable metering device 10 and a connecting line 11 to a combustion chamber or a combustion zone 12. The metering device 10 is preferably configured as a metering valve.

In the combustion zone or the combustion chamber 12, fuel, i.e. gas, from the fuel tank 8 is mixed with air to produce a combustible mixture which is ignited by an ignition device 14 in order to drive a fastening element 6, such as a bolt or a nail, out of the element guide 4 at the setting end 5 into the substrate. When a trigger of the setting tool 1 is actuated, the energy required for driving in is transmitted by means of the driving piston 7 from the combustion chamber 12 to the fastening element 6 at the setting end 5.

For control purposes a controller or control unit 20 is arranged in the setting tool 1. A control line 16, which is also designated as an ignition cable, extends from the controller 20 to the ignition device 14 in the combustion zone 12. By means of the ignition cable 16 the ignitable mixture in the combustion zone 12 is ignited with the aid of the ignition device 14. By means of a control line 17 the metering device 10 is connected in control terms to the controller 20.

The combustion chamber 12, the ignition device 14 and the metering device 10 with the fuel tank 8 constitute a primary drive 21 for the driving piston 7. The primary drive 21 is combined with a secondary drive 22 in a hybrid drive system for the driving piston 7.

The secondary drive 22 is configured as an electric motor-powered drive with an electrical power supply device 23 and an electric motor 24. The electrical power supply device 23 is configured for example as a battery or accumulator and is connected by means of a power supply line to the electric motor 24.

Furthermore, the electric motor 24 is connected in control terms to the controller 20 by means of a control line 18. Thus the controller 20 constitutes a common controller for the primary drive 21 and the secondary drive 22.

The electric motor-powered drive which constitutes the secondary drive 22 is drivingly connected by means of a coupling device 25 to a piston rod 30 of the driving piston 7. The coupling device 25 comprises a gear 26 connected for conjoint rotation to a drive shaft of the electric motor 24.

The gear 26 has an external toothing 27, which is in engagement with a linear toothing 28 and is formed on the piston rod 30 of the driving piston 7. The coupling device 25 can be combined with a clutch (not shown) which allows engagement and disengagement of the electric motor 24.

A display of the setting tool 1 is indicated by a rectangle 34 connected to the controller 20. An input device of the setting tool 1 is indicated by a rectangle 35 likewise connected to the controller 20. Operation-dependent information about the setting tool 1 is visibly presented externally for an operator by means of the display 34. By means of the input device 35 the operator can make inputs on the setting tool 1.

In the accompanying drawing a first position or starting position of the driving piston 7 is indicated by a line 38. The driving piston 7 is retained in its first position or starting position by a magnet device 40. The magnet device 40 comprises, for example, two magnets of which the north and south poles are indicated by rectangles. Alternatively or in addition the driving piston 7 can be retained in its starting position or first position 38 by friction.

The driving piston 7 can be moved out of its first position or starting position 38 into its second position illustrated in the drawing by the primary drive 21 and/or the secondary drive 22. Due to the acceleration of the driving piston 7 associated therewith, the fastening element 6 can be driven into the substrate at the end 5 of the setting tool 1.

After the setting operation the driving piston 7 can be brought back again into its starting position or first position 38 by the thermal piston which is conventional in gas devices or by the secondary drive 22 with the electric motor 24 and the coupling device 25.

The electric motor-powered drive 22 which constitutes the secondary drive can be provided, as illustrated, by means of the motor unit 24 which engages mechanically on the piston rod 30. Alternatively or in addition the electrical drive can take place by means of a coil system (not shown) on the piston guide side and a corresponding counterpart on the piston side, for example in the form of a solenoid plunger. This type of electrical drive is similar to a reciprocating piston magnet.

The setting tool according to the invention can be operated in five different modes of operation. In a first mode of operation, which is also designated as standard combustion, the driving piston 7 is accelerated exclusively by means of the combustion pressure provided by the primary drive 21.

Before the combustion the driving piston 7 is located in its starting position or first position 38, which is also designated as the rearmost position. Due to the ignition of the combustible mixture in the combustion chamber 12 with the aid of the ignition device 14, the driving piston 7 is suddenly moved into the second position illustrated in the drawing, wherein the driving piston 7 is accelerated.

In a first mode of operation, which is also designated as hybrid drive, the driving piston is accelerated both by the combustion pressure provided by the primary drive 21 and also by the electric drive which constitutes the secondary drive 22. In this case the combustion process is started in the hybrid drive system just as in the first mode of operation. Due to the common control 20 for the two drives 21 and 22, during the piston acceleration the electric motor 24, which is associated with the secondary drive 22, is switched on.

In a third mode of operation the secondary or electric motor-powered drive 22, which is also designated as an electrical drive, is used for pre-compression of the combustible mixture in the combustion zone 12. The piston acceleration takes place due to the combustion pressure increased as a consequence of the supercharging. The third mode of operation is also designated as combustion with supercharging.

The driving piston 7 is located initially in its second position illustrated in the drawing in front of the rear position 38. In order to reach a higher oxygen concentration in the combustion chamber 12, the electric motor-powered drive 22 moves the driving piston 7 towards the rear, i.e. towards the combustion chamber 12. In this way the air in the combustion chamber 12 is compressed.

Simultaneously, the gas from the fuel tank 8 is injected by means of the metering device 10 into the combustion chamber 12. Then the ignition takes place by the ignition device 14. The subsequent combustion with the pressure buildup accelerates the piston and moves the piston 7 out of its starting position 38 again into its second position illustrated in the drawing.

In the third mode of operation the electric motor-powered drive 22 is preferably coupled to the driving piston 7 only during the supercharging phase. Subsequently the driving piston 7 is controlled mechanically or electrically and brought out of engagement with the driving piston 7. As a result, an undesirable incorrect loading during the working stroke of the driving piston 7 is prevented in a simple manner.

In addition, in a fourth mode of operation the driving piston 7 is also accelerated in the working direction by the electrical drive 22. The pre-compression of the air in the combustion zone 12 takes place as in the third mode of operation. However, during the acceleration of the driving piston 7 the electric motor-powered drive 22 is additionally switched on for accelerating the driving piston 7. The fourth mode of operation is also designated as a hybrid drive with supercharging.

In a fifth mode of operation the driving piston 7 is accelerated exclusively by the electric motor-powered drive 22. The fifth mode of operation is also designated as an electric drive. The fifth mode of operation with the electric drive is suitable, in particular, for applications in which only a relatively low setting energy is required in order to drive the fastening element 6 into the substrate. At the start of the electric drive the driving piston 7 is located in its first position or starting position 38.

The setting tool 1 according to the invention with the hybrid drive system can be lighter than a conventional gas device and also lighter than a battery-operated setting tool. With the setting tool 1 according to the invention, higher setting energies can be achieved by the hybrid drive system than with conventional setting tools.

The different possibilities for combining the individual drives 21 and 22 make possible a very great variation of the setting energy. With reduced setting energy, gas or accumulator capacity can be saved by comparison with standard energy settings, such as for example a piston advance adjustment.

The invention claimed is:

1. A setting tool for fastening elements, comprising a control unit; a gas-powered primary drive controlled by the control unit; a secondary drive controlled by the control unit; a driving piston driven by the primary drive and the secondary drive; wherein the control unit is operable to control the primary drive and the secondary drive in a first mode of operation and in a second mode of operation, wherein in the first mode of operation, the driving piston is driven solely by the primary drive, and wherein in the second mode of operation, the driving piston is driven by both the primary drive and the secondary drive.

2. The setting tool according to claim 1, wherein the primary drive is a gas combustion-powered drive.

3. The setting tool according to claim 2, wherein the secondary drive is an electric motor-powered drive.

4. The setting tool according to claim 3, wherein the driving piston comprises a piston rod, and wherein the secondary drive is drivingly connected to the piston rod of the driving piston.

5. The setting tool according to claim 1, wherein the secondary drive is an electric motor-powered drive.

6. The setting tool according to claim 5, wherein the driving piston comprises a piston rod, and wherein the secondary drive is drivingly connected to the piston rod of the driving piston.

7. A method for operating a setting tool, which has a gas-powered primary drive, a secondary drive, and a driving piston, the method comprising driving the driving piston in a first mode of operation in which the driving piston is accelerated solely by the primary drive;

driving the driving piston in a second mode of operation in which the driving piston is accelerated by both the primary drive and the secondary drive.

8. The method according to claim 7, further comprising driving the driving piston in a third mode of operation in which the driving piston is accelerated solely by the secondary drive.

9. The method according to claim 7, wherein the primary drive has a combustion chamber and the secondary drive supercharges the combustion chamber by moving the driving piston.

10. The method according to claim 7, wherein the primary drive and the secondary drive are both controlled by a common controller.

* * * * *